US006450209B1

(12) United States Patent
Hirai

(10) Patent No.: US 6,450,209 B1
(45) Date of Patent: Sep. 17, 2002

(54) ELECTRIC SHEDDING DEVICE IN WEAVING MACHINE

(75) Inventor: Jun Hirai, Ishikawa-ken (JP)

(73) Assignee: Tsudakoma Kogyo Kabushiki Kaisha (JP)

( * ) Notice: Subject to any disclaimer, the term of this patent is extended or adjusted under 35 U.S.C. 154(b) by 0 days.

(21) Appl. No.: 09/975,275

(22) Filed: Oct. 10, 2001

(30) Foreign Application Priority Data

Oct. 23, 2000 (JP) ..... 2000-322964

(51) Int. Cl.[7] ..... D03G 13/00; D03D 51/00
(52) U.S. Cl. ..... 139/57
(58) Field of Search ..... 139/57

(56) References Cited

FOREIGN PATENT DOCUMENTS

| | | | | |
|---|---|---|---|---|
| JP | 10-130984 A | | 5/1998 | ..... D03C/13/00 |
| JP | 10130984 | * | 5/1998 | |
| JP | 11107712 | * | 4/1999 | |
| JP | 2000-212849 | | 8/2000 | ..... D03C/13/00 |
| JP | 2000-265338 A | | 9/2000 | ..... D03C/13/00 |
| JP | 2000265338 | * | 9/2000 | |

* cited by examiner

*Primary Examiner*—Andy Falik
(74) *Attorney, Agent, or Firm*—Webb Ziesenheim Logsdon Orkin & Hanson, P.C.

(57) ABSTRACT

A shedding device in a weaving machine including one or more motor groups with a plurality of motors corresponding to a plurality of heald frames which are supported by a plurality of supporting mechanisms arranged in the forward and backward direction of the weaving machine. The motors of each motor group are arranged in the upward and downward, rightward and leftward directions. Two or more motors operating as at least part of the motor group form one or more motor rows. Each motor is connected to the supporting mechanism of a heald frame through a connecting member. Adjacent motors in the motor row or rows are related to non-adjacent heald frames among the heald frames corresponding to the support mechanisms.

6 Claims, 14 Drawing Sheets

ELECTRIC SHEDDING DEVICE IN WEAVING MACHINE

BACKGROUND OF THE INVENTION

1. Field of the invention

The present invention relates to a shedding device for forming a warp shedding in a weaving machine.

In this invention, a reciprocating direction of a heald frame is called a upward and downward direction; the moving direction of a warp by letting off of the warp, a forward and backward direction; the downstream side in a warp running direction, a front side; the upstream side in a warp running direction, a rear side; and a weaving width direction of the weaving machine, a rightward and leftward direction.

2. Description of Prior Art

As one of devices for forming a warp shedding by moving a plurality of heald frames vertically is disclosed an electric shedding device in which each heald frame is supported by a support mechanism so as to move vertically and each support mechanism is driven by a drive motor provided at every heald frame (Japanese Patent Appln. PD (KOKAI) No. 10-130984).

Each drive motor moves a corresponding heald frame vertically by having its output shaft connected with a corresponding support mechanism, through a mechanism for converting motion for converting the drive motor's rotation into a reciprocal motion and a connecting mechanism such as a long connecting member for transmitting the converted reciprocal motion to the support mechanism, and driving the support mechanism.

The foregoing shedding device uses sixteen drive motors. The sixteen drive motors are divided into two motor groups each including eight motors arranged in the upper and lower as well as right and left sides of the weaving machine, with motor shafts, i.e., output shafts assembled to the outside of a frame of the weaving machine so as to extend in the forward and backward direction of the weaving machine.

Among the drive motors of each motor group, four drive motors located on the lower side are arranged in the rightward and leftward direction of the weaving machine to form a lower side motor row, while four drive motors located on the upper side are arranged in the rightward and leftward direction of the weaving machine to form an upper side motor row. Both motor groups are spaced apart in the forward and backward direction of the weaving machine.

In the foregoing conventional shedding device, the drive motors adjoining in the rightward and leftward direction of the weaving machine are made to correspond to heald frames adjoining in the forward and backward direction of the weaving machine to drive the corresponding heald frames. Also, a crank connecting rod of each mechanism for converting motion extends from the corresponding drive motor to transverse the front or the rear of an eccentric wheel of the mechanism for converting motion located next to the drive motor.

In view of the above, in the conventional shedding device, half the sum of the thicknesses of the eccentric wheel and the crank connecting rod which transverse the front or the rear of the eccentric wheel should be one pitch or less of the array of the heald frames. Accordingly, the thicknesses of members including the eccentric wheel and the crank connecting rod must be made small, which deteriorates the durability of those members and causes a vibration.

Also, in the conventional shedding device, in order not to make the crank connecting rods transverse the front or the rear of the eccentric wheels of adjoining drive motors, the drive motors should be arranged such that the plural crank connecting rods connected with the drive motors in the same motor row do not overlap in the forward and backward direction, that is, such that two adjoining crank connecting rods form a large angle therebetween, which requires a larger space to dispose the drive motors.

SUMMARY OF THE INVENTION

It is an object of the present invention to arrange drive motors efficiently in a shedding device of a weaving machine comprising a drive motor at every heald frame, without lowering the strength of members constituting a mechanism for converting motion.

In this invention, a reciprocating direction of a heald frame is called a upward and downward direction; the moving direction of a warp by letting off of the warp, a forward and backward direction; the downstream side in a warp running direction, a front side; the upstream side in a warp running direction, a rear side; and a weaving width direction of the weaving machine, a rightward and leftward direction.

A shedding device in a weaving machine according to the present invention comprises: a support mechanism group including a plurality of support mechanisms for individually supporting heald frames so as to move vertically; a motor group including a plurality of motors provided at every heald frame with an output shaft directed in the forward and backward direction of the weaving machine; and a motion converting mechanism group including a plurality of mechanisms for converting motion each having a long connecting member for connecting the motors with the corresponding support mechanisms.

The motors of the motor group are disposed on the upper, lower, right and left sides, two or more motors constituting at least part of the motor group form one or more motor rows arranged in the longitudinal direction of the connecting member, and the adjoining motors within the motor row are related to heald frames not adjoining within the heald frames corresponding to the support mechanism.

By arranging the motors on the upper, lower, right and left sides, forming a rightward and leftward motor row with two or more motors, and relating the adjoining motors forming the motor row to heald frames not adjoining in the forward and backward direction within the heald frames corresponding to the support mechanisms, a distance between the heald frames relating to thus adjoining motors, in particular, a distance in the forward and backward direction is enlarged. Accordingly, a distance between the mechanisms for converting motion assembled to the output shafts of the motors and adjoining in the forward and backward direction can be enlarged.

As a result of the above, a mutual intervention of the mechanisms for converting motion individually assembled to the output shafts of the plural motors forming the motor rows can be prevented. Also, even if those mechanisms for converting motion transverse the front or the rear of at least one mechanism for converting motion, the sum of the thicknesses of the adjoining mechanisms for converting motion, in particular, the sum of the thicknesses of the members located near the output shafts of the motors among the members constituting those adjoining mechanisms for converting motion, is not limited to the arrangement pitch of the heald frames adjoining in the forward and backward direction. Furthermore, without enlarging the space to dispose the motors, the mechanical strength of the mechanisms for converting motion can be enhanced.

In a preferred embodiment, the shedding device is constituted to have the support mechanism group support part of the plural heald frames in the weaving machine and, furthermore, comprises a second support mechanism group including a plurality of second support mechanisms individually supporting other heald frames so as to move upward and downward; a second motor group including a plurality of second motors provided at every heald frame with the output shaft directed in the forward and backward direction of the weaving machine; and a second motion converting mechanism group including a plurality of second mechanisms for converting motion having long second connecting members for connecting the second motors with the corresponding second support mechanisms. The second motors of the second motor group are arranged on the upper, lower, right and left sides, two or more of the second motors constituting at least a part of the second motor group form one or more second motor rows are arranged in the longitudinal direction of the second connecting member, and the adjoining motors within the second motor row are related to the heald frames not adjoining within the heald frames corresponding to the second support mechanism.

The second motor group and the motor group mentioned previously can be disposed in different positions at least in one direction selected from the forward and backward, upward and downward, and rightward and leftward directions. By doing so, many motors can be more efficiently arranged without lowering the strength of the members constituting the mechanisms for converting motion.

The motors in the same motor row can be arranged such that the motors nearer to the end portion of the connecting member on the side opposite to the motors are related to the heald frames on one of the forward side and the backward side nearer to the side where the motor group are arranged, among the heald frame corresponding to the support mechanism. This enables to prevent a mutual intervention of the mechanisms for converting motion relating to the motors within the same motor row more surely.

The heald frame adjacent to the heald frame related to the motors of the same row can be related to other motors not belonging to the same row among the motors of the motor groups. This enables to prevent more surely a mutual intervention of the mechanisms for converting motion related to the motors of the same motor row.

In a preferred embodiment, the motors of the motor group are arranged in a plurality of rows respectively in the widthwise direction and upward and downward direction of the weaving machine; the heald frames supported by the support mechanisms of the support mechanism group are divided into a plurality of groups to which the heald frames of the same group are adjacent, each group including the number of heald frames corresponding to the number of the motors in each of the upper and the lower rows; the motors in the first upper and lower rows nearest to the end portion of the connecting member on the side opposite to the motor side are made to correspond to the heald frames of the first group nearest to either the forward side or the backward side where the motor groups are disposed; and the motors of the other upper and lower rows and the heald frames of the other group are made to correspond such that the order of their proximity relative to the first upper and lower rows to which the motors belong coincides with the order of proximity relative to the first upper and lower rows to which the heald frames belong.

DETAILED DESCRIPTION OF THE PREFERRED EMBODIMENTS OF THE INVENTION

Figure 1:
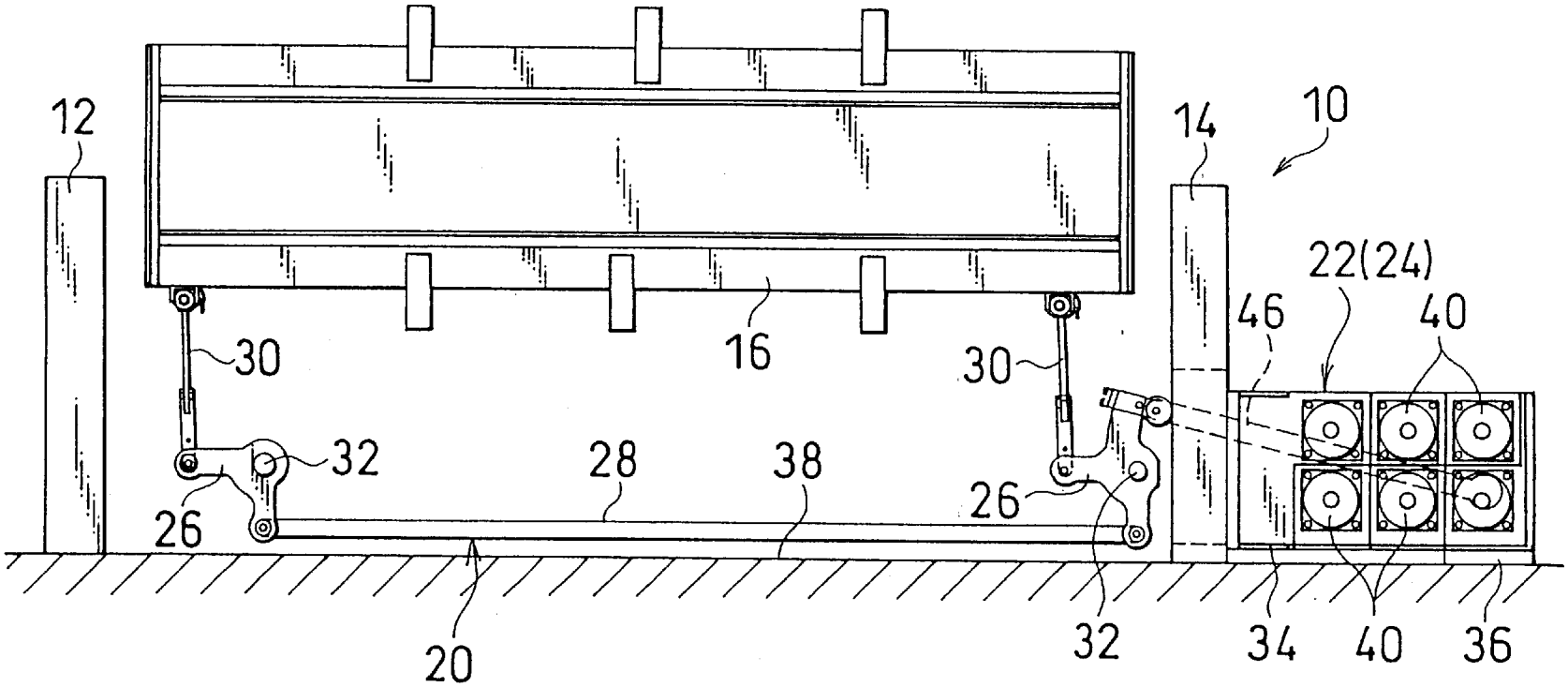
FIG. 1 is a front elevation view showing an embodiment of the shedding device according to the present invention
Figure 2:
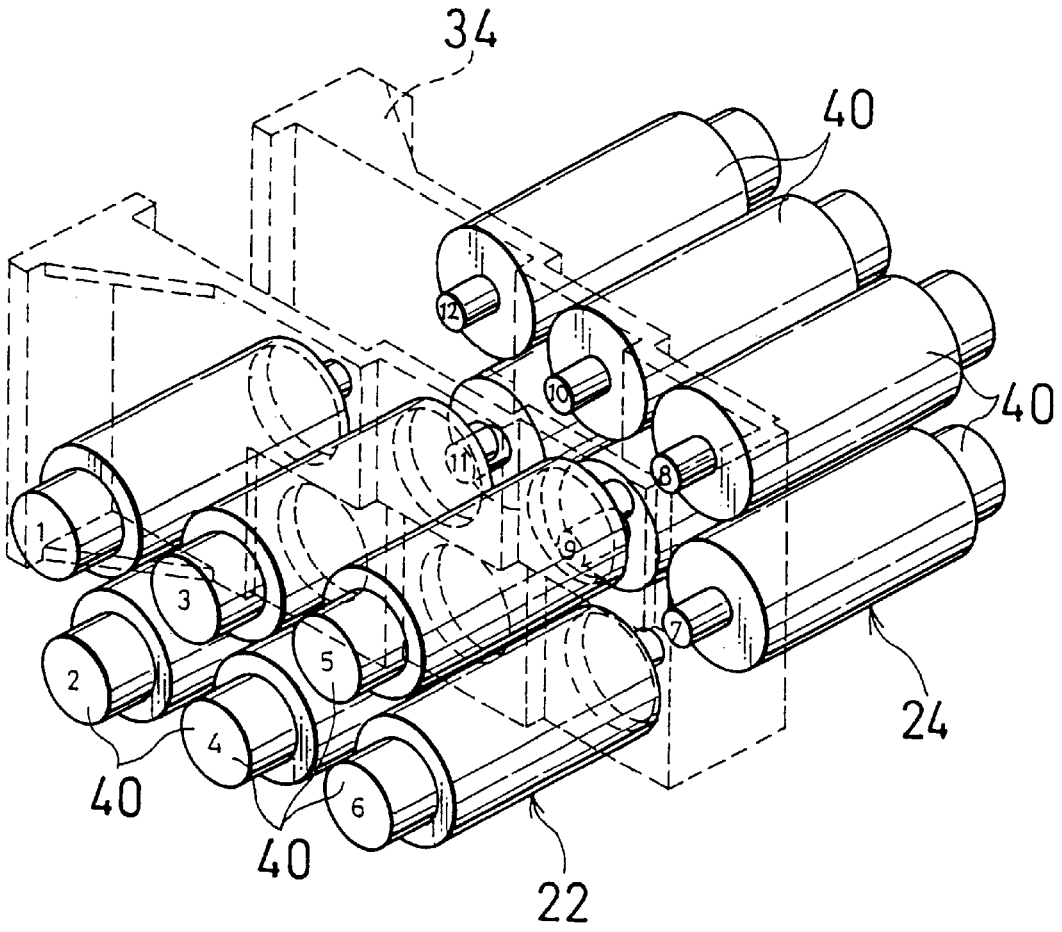
FIG. 2 is a perspective view showing an arrangement example of the motor groups used in the shedding device in FIG. 1.
Figure 3:
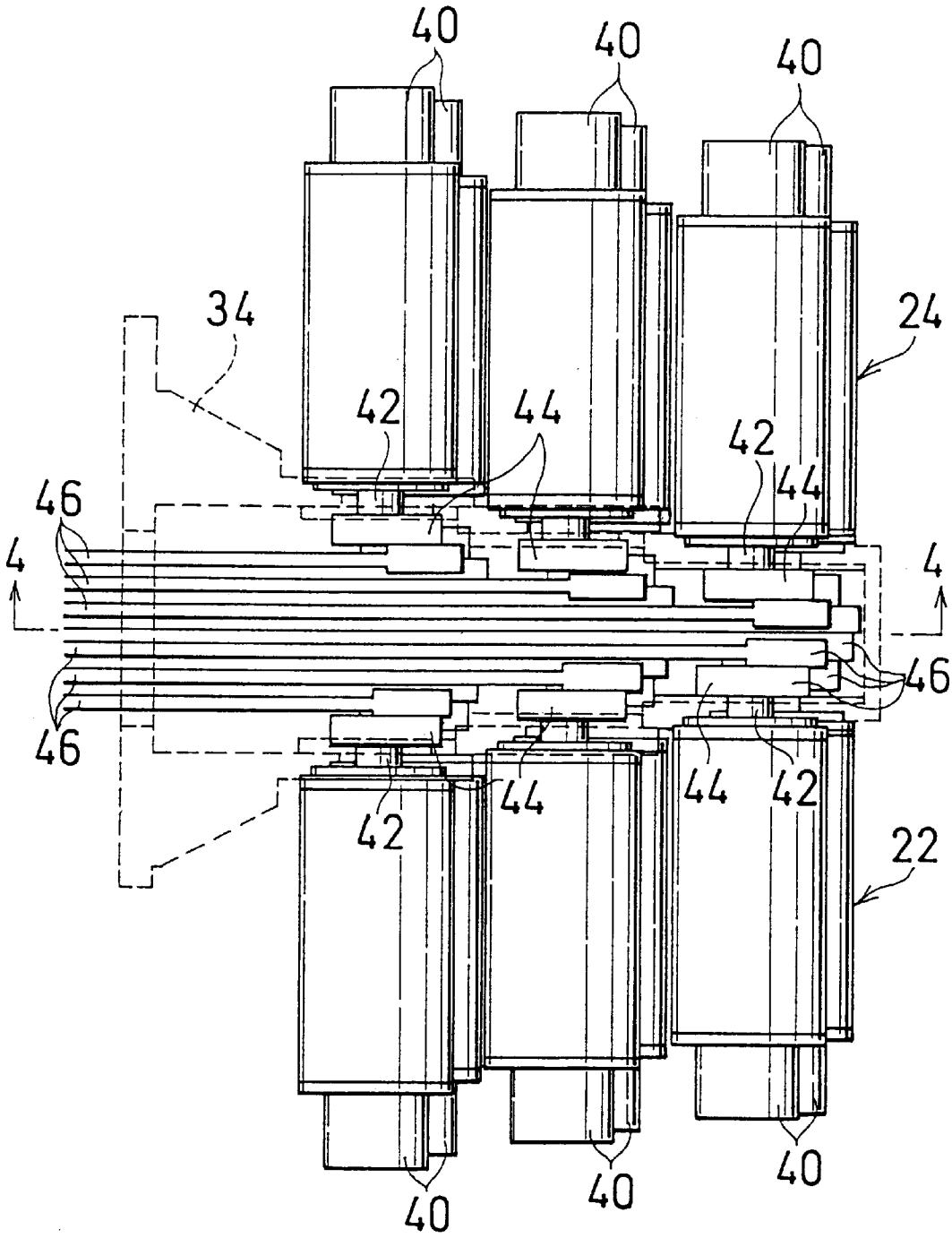
FIG. 3 is a plan view showing an arrangement example of drive mechanism groups used in the shedding device of FIG. 1.
Figure 4:
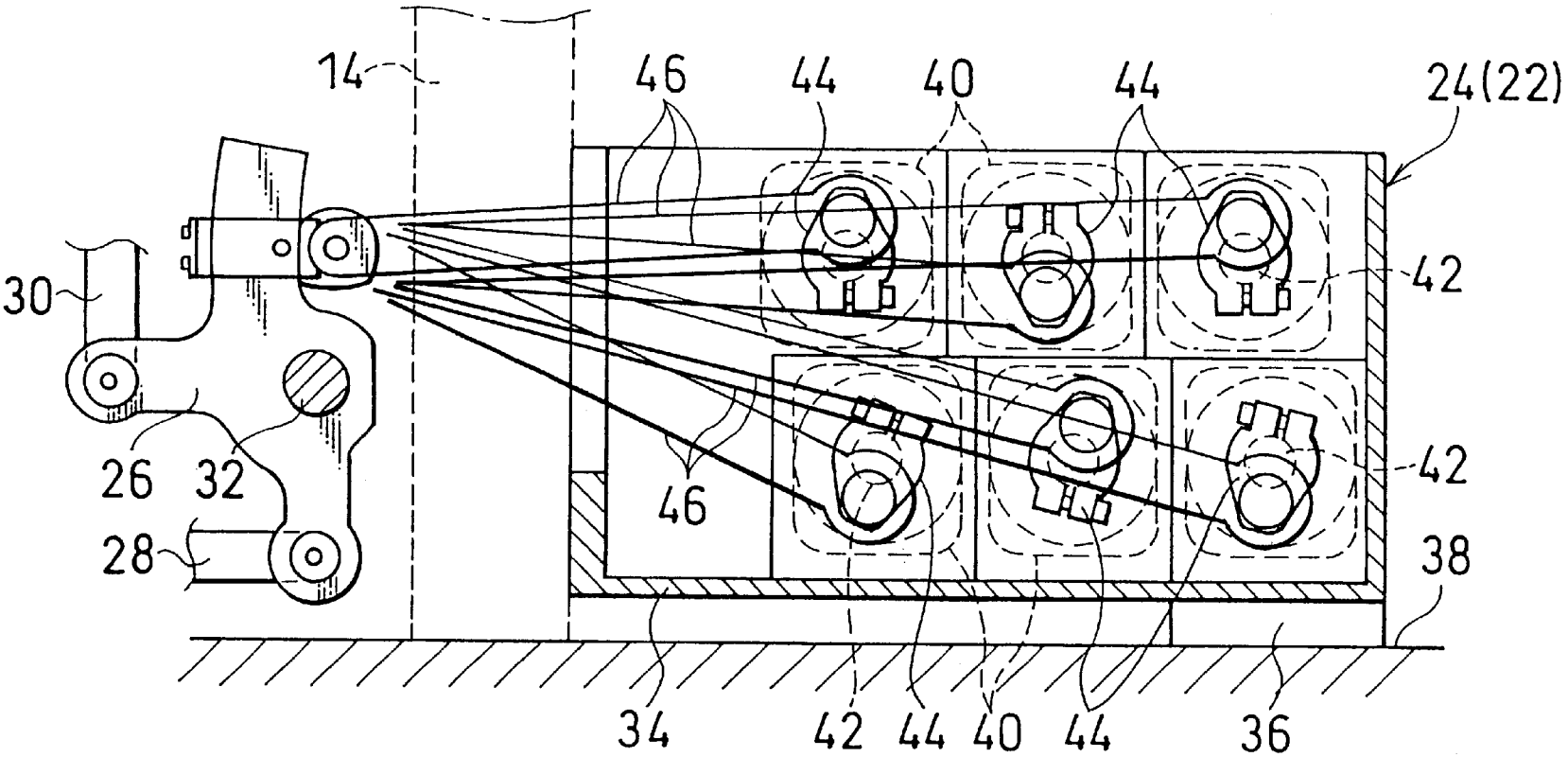
FIG. 4 is a sectional view taken along line 4—4 in FIG. 3.

Referring to FIGS. 1 through 6, a shedding device 10 is used as an electric shedding device which forms a warp shedding by reciprocating upward and downward a plurality of heald frames 16 arranged at intervals in the forward and backward direction between right and left frames 12, 14 of the weaving machine together with the healds disposed on the heald frames 16. In FIG. 1, a warp is moved in a direction perpendicular to a sheet by a let-off from a warp beam not shown, while a weft is run from the left side to the right side (or vice versa).

The heald frames 16 are divided, according to their arrangement positions in the forward and backward direction of the weaving machine, into a first heald frame group including a plurality of heald frames located on the forward side (cloth fell side) and a second heald frame group including a plurality of heald frames located on the backward side (opposite side to the cloth fell). In the illustration, the weaving machine includes twelve heald frames 16; accordingly, each heald frame group is provided with six heald frames.

The shedding device 10 comprises a first and a second support mechanisms including a plurality of support mechanisms 20 provided at every heald frame 16 and supporting the corresponding heald frames 16 so as to move upward and downward, and a first and a second drive mechanism groups 22 and 24 including a plurality of drive mechanisms individually made to correspond to the support mechanisms 20 of the support mechanism groups. In the illustration, since each heald frame group includes six heald frames 16, each support mechanism group and each drive mechanism group include six support mechanisms and six drive mechanisms, respectively.

The support mechanisms 20 of the first support mechanism group are made to individually correspond to the heald frames 16 of the first heald frame group and the drive mechanisms of the first drive mechanism group 22 and, driven by the corresponding drive mechanisms, move the corresponding heald frames 16 upward and downward. The support mechanisms 20 of the second support mechanism group are individually made to correspond to the heald frames 16 of the second heald frame group and the drive mechanisms of the second drive mechanism group 24 and, driven by the corresponding drive mechanisms, move the corresponding heald frames 16 upward and downward.

Each support mechanism 20 is a known mechanism which connects a pair of right and left V-shaped or Y-shaped swinging levers 26 by means of a link 28 extending in the rightward and leftward direction and connects each swinging lever 26 with the heald frame 16 by supports 30 extending in the upward and downward direction. Both swinging levers 26 and the link 28, the heald frames 16 and the supports 30 are pivotally connected.

The swinging lever 26 on the left side is V-shaped, while the swinging lever 26 on the right side is Y-shaped. Both swinging levers 26 are pivotally connected with the link 28 at respective one ends of their V- or Y-shaped forms and are pivotally connected with the supports 30 at their respective other front ends of V- or Y-shaped forms.

The right and left swinging levers 26 are respectively supported on right and left support shafts 32 common to each of the right and left swinging levers at the base portions of the V- or Y-shaped forms, i.e., at their branching portions so as to swing within a plane extending vertically and laterally.

The support shafts 32 extend between the frames 12, 14 in the forward and backward direction and are supported on corresponding frames through a bracket not shown. The supports 30 are connecting members having one end portion of a screw rod screwed into a screw hole of an elongated female screw body.

Each drive mechanism of the first drive mechanism group 22 is made to correspond to the heald frame 16 located in the front, that is, the heald frame 16 of the first heald frame group, while each drive mechanism of the second drive mechanism group 24 is made to correspond to the heald frame 16 of the second heald frame 16 located in the rear.

Each drive mechanism of the first and the second drive mechanism groups 22 and 24 is assembled into a bracket 34 which is assembled on the outer surface of the right frame 14 such that the second drive mechanism groups 22 and 24 are symmetric relative to an imaginary line passing the center in the forward and backward direction of the position where the heald frames are arranged. The bracket 34 is provided on a floor 38 through a leg portion 36.

Each drive mechanism has a drive source or an electric motor 40 such as a servomotor assembled into the bracket 34 such that the rotation axis extends in the forward and backward direction, an eccentric joint 44 assembled into an output shaft 42 of the motor 40, and an elongated connecting member 46 pivotally connected with the eccentric joint 44 at one end.

The connecting member 46 is a long plate-like link and is pivotally connected at the other end with the remaining front end of the Y-shaped right swinging lever 26. The connecting member 46, however, may be a connecting rod.

Figure 7:
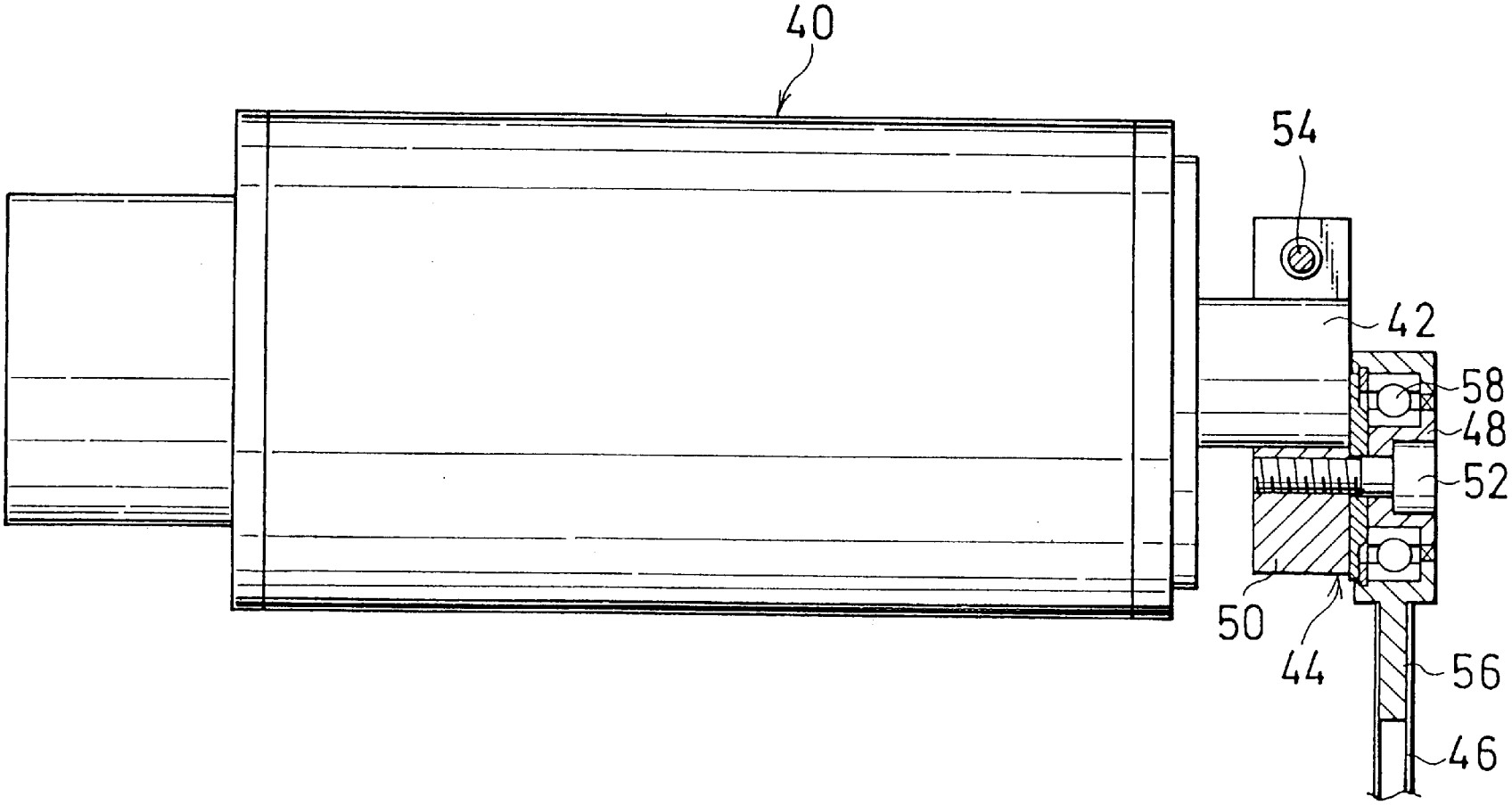
FIG. 7 is a view showing an embodiment of a drive motor.
Figure 8:
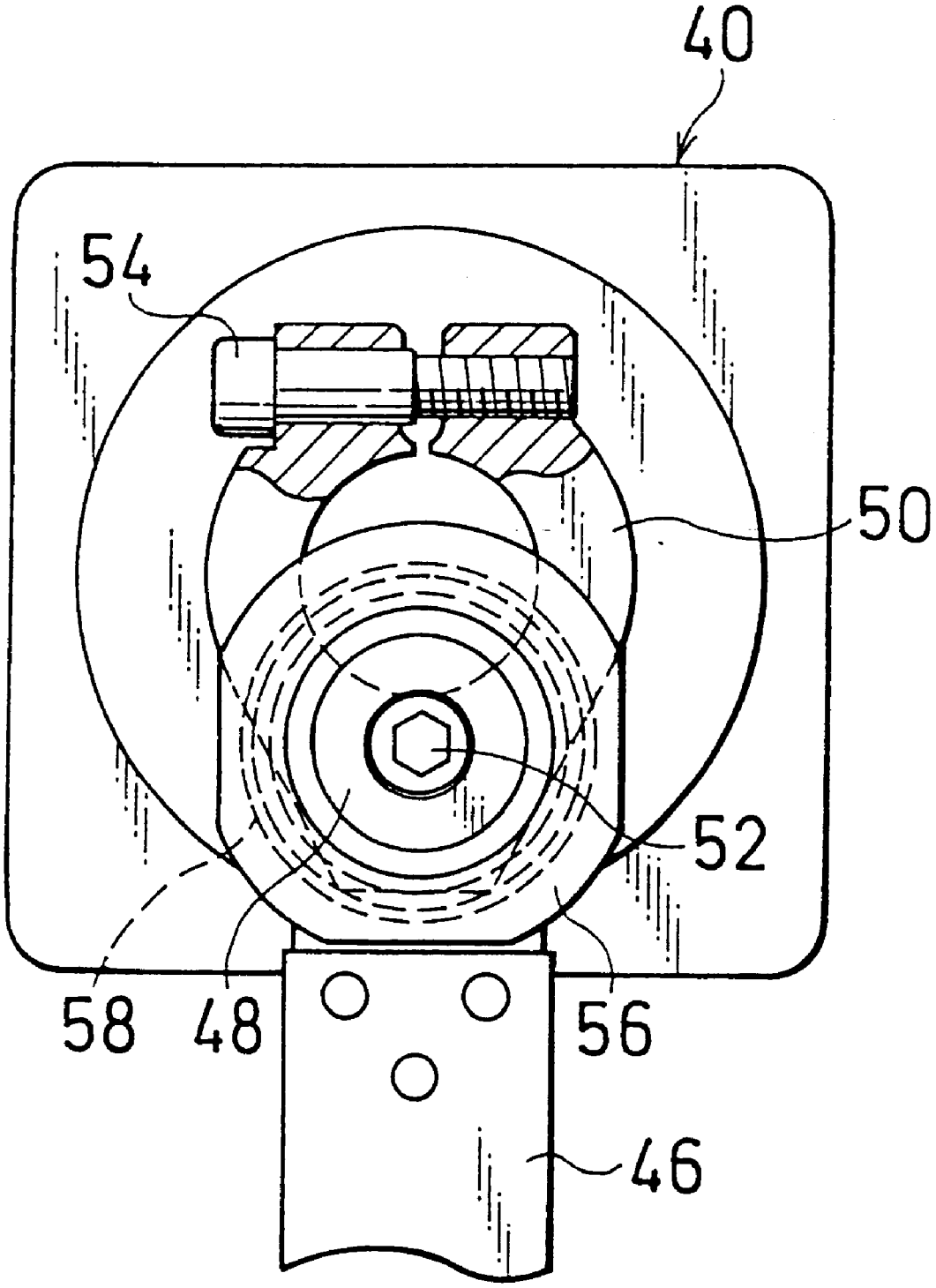
FIG. 8 is a right side view of the drive motor shown in FIG. 7.

Each eccentric joint 44, as shown in FIGS. 7 and 8, includes a disk-shaped cam 48 whose outer face is a cam face; an assembling implement 50 for assembling the cam 48 into the output shaft 42 of the motor 40; and a screw member 52 for assembling the cam 48 into the assembling implement 50 in an eccentric state. The assembling implement 50 is assembled into the output shaft 42 by the screw member 54.

Each connecting member 46 is fitted on the cam face of the cam 48 at a cam follower 56 connected with one end of the connecting member 46 so as to be relatively moved by a bearing 58. Consequently, the eccentric joint 44 of each drive mechanism and the cam follower 56 form a crank chain serving as a mechanism for converting motion for converting the rotational motion of the motor 40 into a reciprocal motion.

The motors 40 of the first and the second drive mechanism groups 22 and 24 are assembled into the bracket 34 such that the output shafts 42 extend in the forward and backward direction, and arranged in the upper, lower, right and left sides at every drive mechanism group to form the first and the second motor groups respectively.

In the illustration, in both drive mechanism groups 22, 24, the motors 40 form two motor rows arranged in the longitudinal (rightward and leftward) direction of the connecting member 46. The upper and lower motors 40 are arranged in the same positions in the rightward and leftward direction.

Adjoining motors 40 of each motor row are made to correspond to heald frames not adjoining in the forward and backward direction among the heald frames 16 corresponding to the drive mechanisms 22 or 24 (that is, the first or the second motor group) to which the adjoining motors 40 belong.

For this reason, the motors 40 forming the upper motor row among the motors of the first drive mechanism group 22 are made to correspond to the heald frames 16 in the odd numbered positions from the front side, while the motors 40 forming the lower motor row are made to correspond to the heald frames 16 in the even numbered positions from the front side.

On the other hand, among the motors of the second drive mechanism group 24, the motors 40 forming the upper motor row are made to correspond to the heald frames 16 in the even numbered positions from the front side, while the motors 40 forming the lower motor row are made to correspond to the heald frames 16 in the odd numbered positions from the front side.

Also, the first drive mechanism group 22 is disposed on the forward side in the forward and backward direction, and the motors 40 forming each motor row of the first drive mechanism group 22 are made to correspond to the heald frames such that the nearer the motors are to the end portion of the connecting members 46 on the side opposite to the motors (frame 14 side), they correspond to the more forward heald frame. On the other hand, the second drive mechanism group 24 is disposed on the backward side in the forward and backward direction and the motors 40 forming each motor row of the second drive mechanism group 24 such that the nearer the motors are to the end portion of the connecting members 46 on the opposite side to the motors, the more backward heald frame they correspond to.

Concretely, the motors 40 forming the upper motor row of the first drive mechanism group 22 are connected with the heald frames through a support mechanism or the like such that the motors in the order from the side of the frame 24 respectively correspond to the first, the third and the fifth heald frames from the forward side. On the other hand, the motors 40 forming the lower motor rows of the first drive mechanism group 22 are connected with the heald frames through a support mechanism or the like such that the motors in the order from the side of the frame 24 respectively correspond to the second, the fourth and the sixth heald frames from the forward side.

Likewise, the motors 40 forming the upper motor row of the second drive mechanism group 24 are connected with the heald frames through a support mechanism or the like such that the motors in the order from the side of the frame 24 respectively correspond to the twelfth, the tenth and the eighth heald frames from the forward side. On the other hand, the motors 40 forming the lower motor row of the second drive mechanism group 24 are connected with the heald frames through a support mechanism or the like such that the motors in the order from the side of the frame 24 respectively correspond to the eleventh, the ninth and the seventh heald frames from the forward side.

Figure 5:
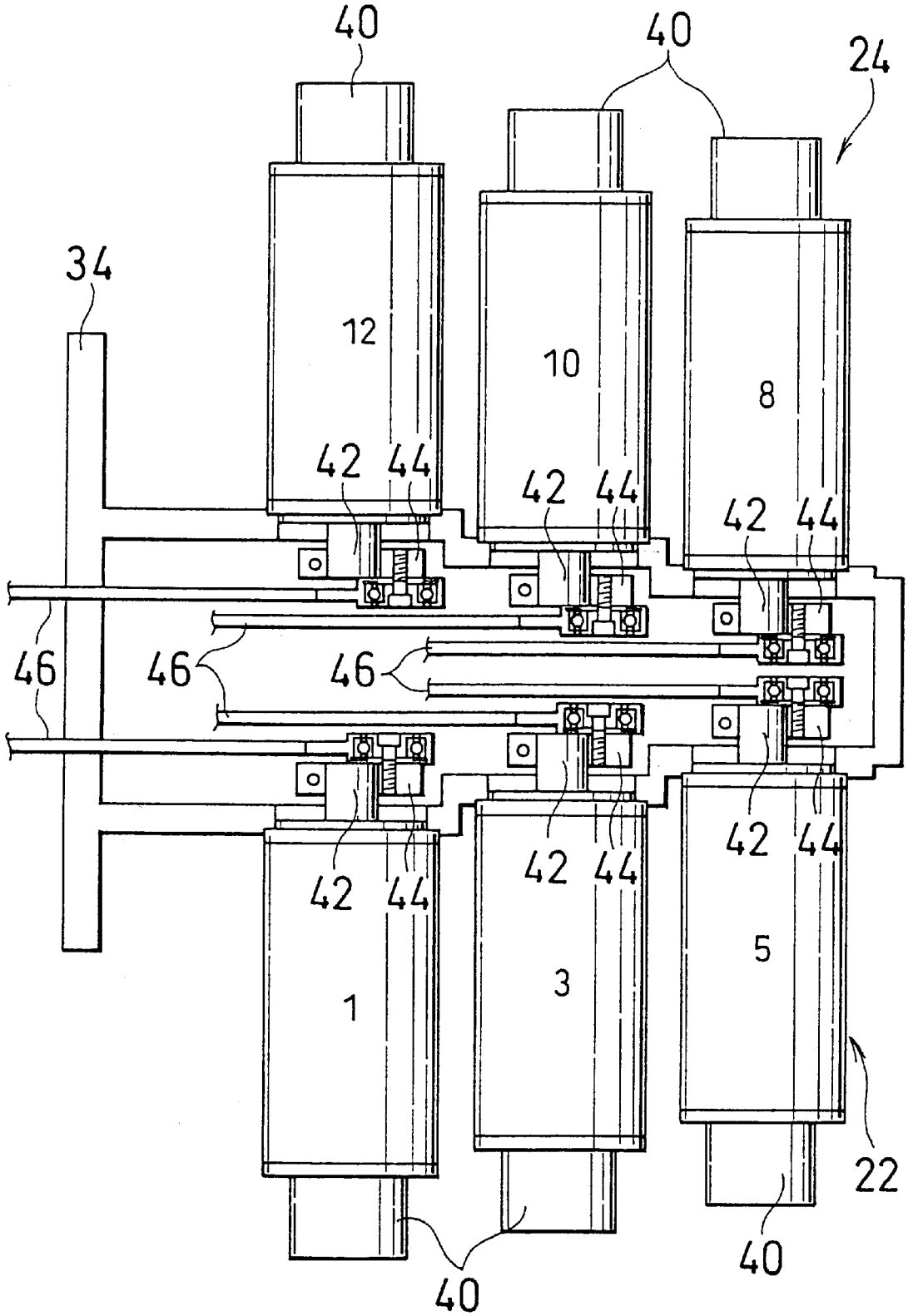
FIG. 5 is a view for explaining a correspondence between upper side drive motors and heald frames of the drive mechanism group shown in FIG. 3.
Figure 6:
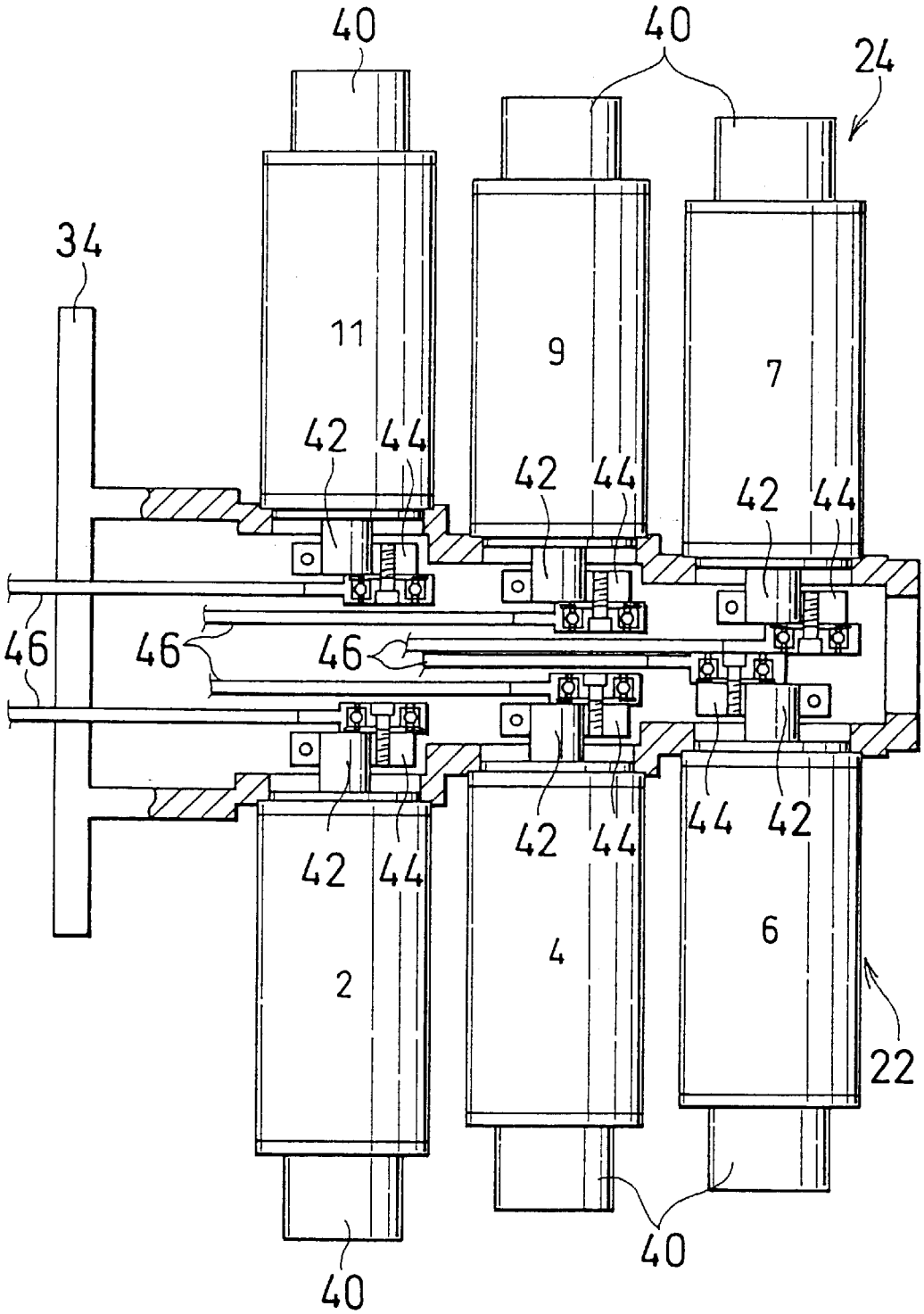
FIG. 6 is a view for explaining a correspondence between the lower side drive motors and heald frames of the drive mechanism group shown in FIG. 3.

The relations between the motors 40 and the heald frames 16 such as above are shown in FIGS. 5 and 6. FIG. 5 shows the position numbers from the front side of the heald frames 16 corresponding to the motors 40 of the upper motor row, while FIG. 6 shows the position numbers from the forward side of the heald frames 16 corresponding to the motors 40 of the lower motor row. In the drawings, the Arabic numerals 1 through 12 placed inside the motors 40 indicate the order of the corresponding heald frames.

The correspondence relation between each motor 40 of the first drive mechanism group 22 and each heald frame 16 can be explained as follows. Six heald frames 16 are divided into three groups consisting of adjoining heald frames 16 corresponding to two motors in the upper and the lower rows of the first drive mechanism group, in more detail, a group including the head frames of position Nos. 1 and 2, a group including the head frames of position Nos. 3 and 4, and a group including the heald frames of position Nos. 5 and 6, and the two motors 40 in the first upper and lower rows nearest to the end portion of the connecting member 46 on the side opposite to the motors are made to correspond to the heald frames (including the heald frames of position Nos. 1 and 2) in the first group nearest to the forward side where the first mechanism group 22 is located, while the two motors 40 in the other upper and lower rows and the heald frames of the other group are made to correspond such that the order of proximity in the upper and lower rows to which the motors 40 belong relative to the first upper and lower rows coincides with the order of proximity of the group to which the heald frames belong relative to the first group.

In the shedding device 10, with the rotation of the motors 40, the cam 48 of the corresponding eccentric joint 44 is rotated in an eccentric state, so that the corresponding connecting member 46 is reciprocated in the rightward and leftward direction. Thereby, the corresponding swinging levers 26 are swung, the support body 30 is reciprocally moved upward and downward, and accordingly, the corresponding heald frames 16 are reciprocally moved upward and downward.

The rotation of each motor 40 of the first and the second drive mechanism groups 22 and 24 is controlled independently, while being synchronized with the rotation of the motor of the weaving machine. Thereby, the heald frames 16 corresponding to the first and the second drive mechanism groups 22 and 24 are reciprocally moved upward and downward, based on a predetermined shedding pattern.

In the shedding device 10, adjoining motors 40 forming each motor row of the drive mechanism groups 22, 24 are connected with the heald frames 16 not adjoining in the forward and backward direction among the heald frames 16 corresponding to the support mechanism, so that the distance, particularly the distance in the forward and backward direction, of the heald frames 16 connected with the adjoining motors 40 in each motor row is enlarged, and accordingly, the distance between adjacent mechanisms for converting motion which are individually assembled into the output shafts 42 of the motors 40 and adjacent in the forward and backward direction can be enlarged.

As a result, mutual intervention between the mechanisms for converting motion corresponding to adjoining motors 40 in each motor row such as the cam 48 as well as the screw member 52 and the connecting member 46 opposing thereto can be prevented. Namely, even if such a mechanism for converting motion traverses the front or the rear of at least one mechanism for converting motion, the sum of the thicknesses of the adjoining mechanisms for converting motion, particularly, the sum of the thicknesses of the eccentric joint 44 and the cam follower 56 of the mechanisms for converting motion is not limited to be the arrangement pitch or less of the heald frames 16 adjoining in the forward and backward direction. Furthermore, the mechanical strength of the mechanism for converting motion can be enhanced without enlarging the space to arrange the motors 40.

In the shedding device 10, the first and the second drive mechanism groups 22 and 24 are respectively drive mechanism groups corresponding to the heald frames 16 located in the forward and backward positions. Also, the motors 40 of the first drive mechanism group 22 nearer to the frame 14 are connected with the heald frames 16 positioned more forward, while the motors 40 of the second drive mechanism group nearer to the frame 14 are connected to the heald frames 16 positioned more backward, respectively. Therefore, as a result of the above, mutual intervention between the mechanisms for converting motion connected with the motors within the same motor row can be more surely prevented.

In the shedding device 10, furthermore, since the first and the second drive mechanism groups 22 and 24 are disposed in positions different in the forward and backward direction, many motors 40 can be more efficiently arranged without lowering the strength of the members composing the mechanisms for converting motion.

In the foregoing embodiment, while the motors are disposed in three by two rows in each drive mechanism group, the number of the motors in the upper and the lower motor rows and the method of arranging them are not restricted to the above embodiment. Also, three or more motor rows may be formed in each drive mechanism group, or, in place thereof, one or more other motors may be disposed above or below the one motor row.

Figure 9:
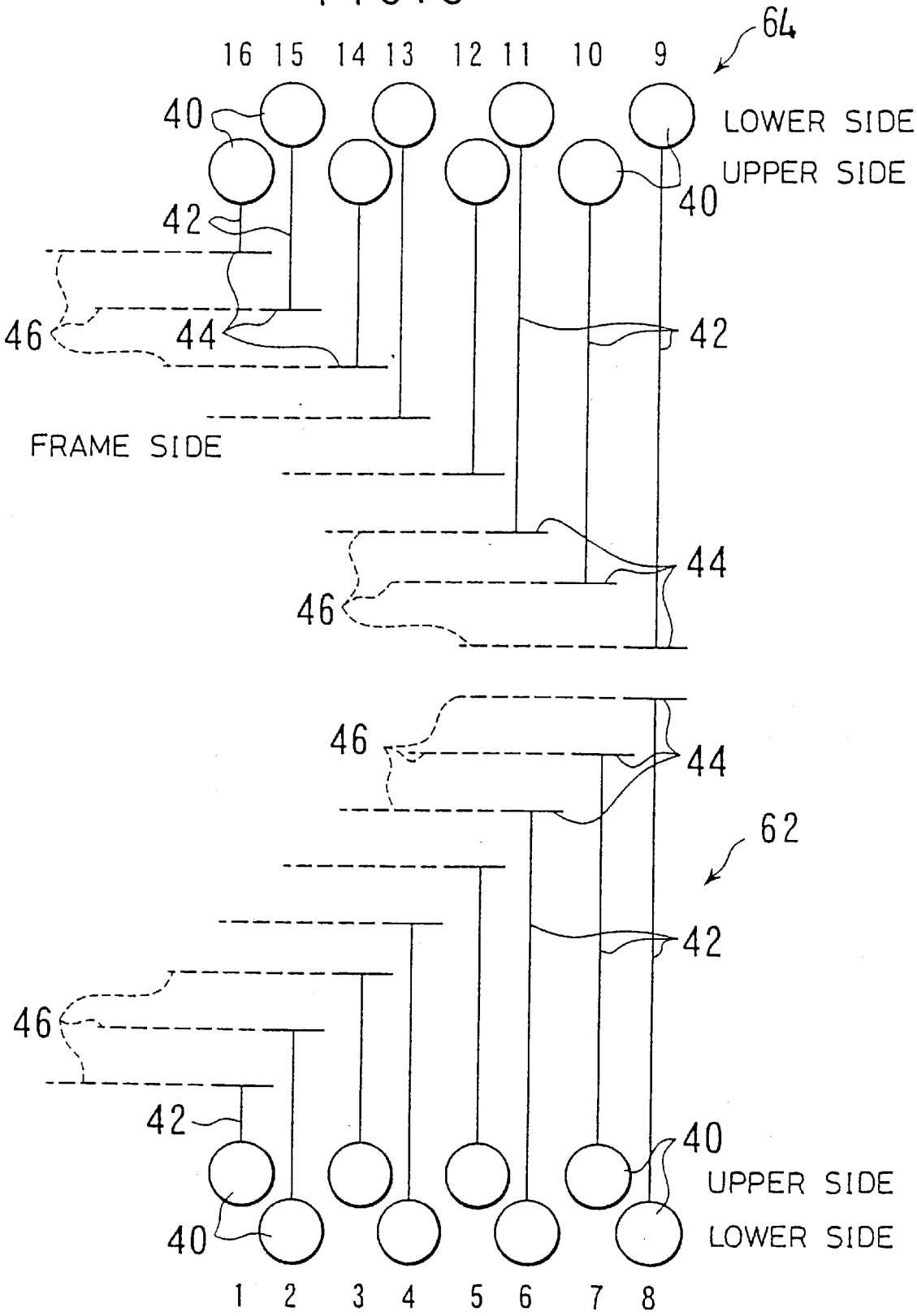
FIG. 9 is a view showing a second example of an arrangement of the drive mechanism group.

FIG. 9 shows an embodiment of a first and a second drive mechanism groups 62 and 64 arranged in positions different in the forward and backward direction. Though FIG. 9 is a plan view, an array of the sixteen motors in a side view. Each drive mechanism group includes eight drive motors 40. Eight motors 40 of each drive mechanism group form two motor groups arranged in the upward, downward, rightward and leftward directions, and each of the two motor rows arranged in two rows has four motors in the longitudinal direction of the connecting members 46.

Adjoining motors 40 within each motor row are made to correspond to the heald frames not adjoining in the forward and backward direction among the heald frames 16 corresponding to the drive mechanisms (i.e., motor groups) to which the motors belong.

Consequently, among the motors of the first drive mechanism group 62, the motors 40 forming the upper motor row are made to correspond to the heald frames 16 in the odd numbered positions from the forward side, while the motors 40 forming the lower motor row are made to correspond to the heald frames 16 in the even numbered positions from the forward side.

On the other hand, among the motors of the second drive mechanism group 64 the motors 40 forming the upper motor row are made to correspond to the heald frames 16 in the even numbered positions from the forward side, while the motors forming the lower motor row are made to correspond to the heald frames 16 in the odd numbered positions from the forward side.

Furthermore, as for the motors 40 forming each motor row of the first drive mechanism group 62, the nearer motors to the end portion of the side opposite to the motors (frame 14 side) of the connecting member 46 are made to correspond to the heald frames positioned more forward. On the other hand, the nearer the motors 40 forming each motor row of the second drive mechanism group 64 are to the end portion of the connecting member 46 on the side opposite to the motors, the more backward heald frames they are made to correspond to. The correspondence relation between the motors and the heald frames such as above is shown in FIG. 9 with the letters "upper side" and "lower side" as well as the Arabic numerals of 1 through 16 indicating the order of the corresponding heald frames from the forward side. The positions respectively of the motors 40 in the upper motor row and those in the lower motor row are displaced in the rightward and leftward direction.

Each motor 40 is assembled into the common frame by a common bracket. The positions of the motors 40 in the forward and backward direction are the same in each drive mechanism group, that is, each motor group. Therefore, the length dimensions of the output shafts of the respective motors 40 are different.

Figure 10:
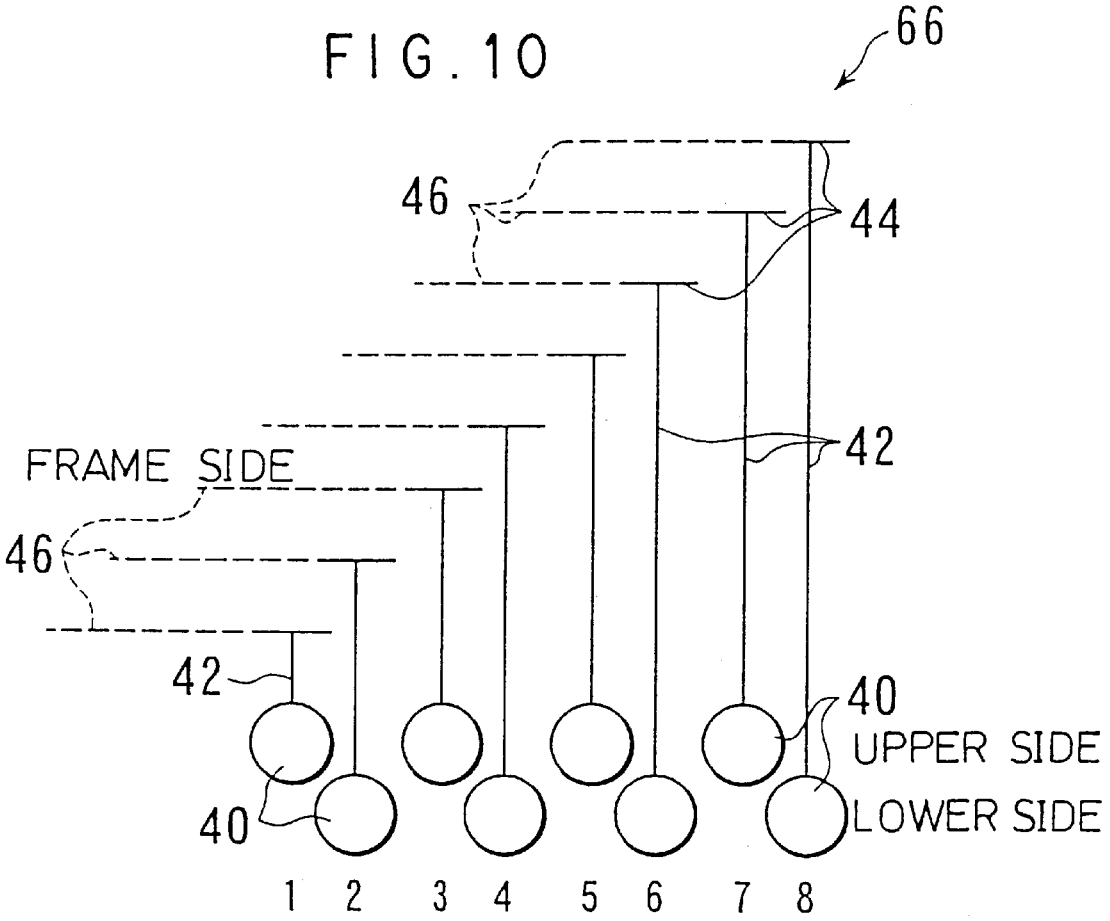
FIG. 10 is a view showing a third example of an arrangement of the drive mechanism group.

FIG. 10 shows an embodiment of a drive mechanism group 66 which is a shedding device using eight drive motors, in which a motor group forming two motor rows with eight drive motors 40 are arranged in the upward, downward, rightward and leftward directions, four each in one row in the longitudinal direction of the connecting member. The drive mechanism group 66 and the motors 40 are related in a similar manner to the drive mechanism group 62 and the motors 40 in FIG. 9. Such a relation between the motors and heald frames is shown in FIG. 10 with the Arabic numerals 1 through 8 indicating the order of the corresponding heald frames from the forward position.

Figure 11:
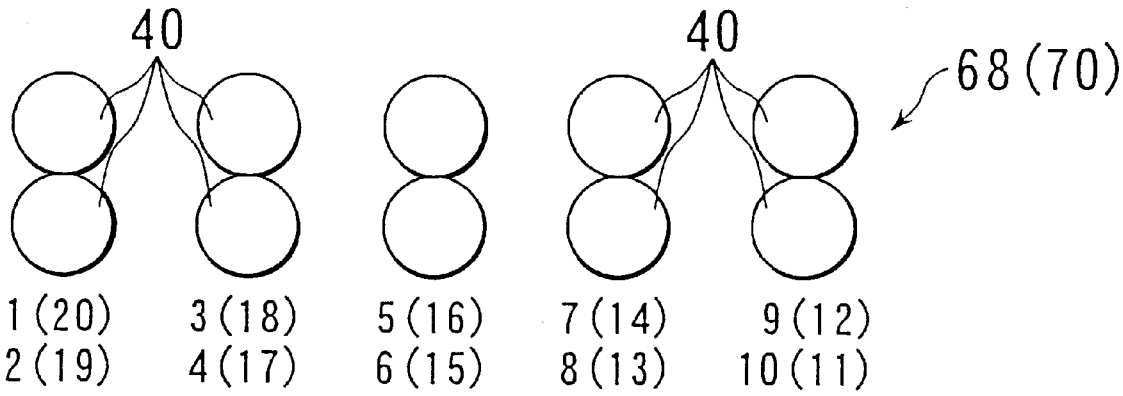
FIG. 11 is a view showing a fourth example of an arrangement of the drive mechanism group.

FIG. 11 shows an embodiment of a drive mechanism group 68 (or two drive mechanism groups 68, 70 each having ten drive motors 40 for ten heald frames and support mechanisms) including a motor group forming two motor rows with ten drive motors 40 arranged in the upward, downward, rightward and leftward directions in the upper and the lower two rows each having five motors in the longitudinal direction of the connecting member 46.

The upper and the lower motors are disposed in the same positions in the rightward and leftward direction. Like the drive mechanism group 62 and the motors 40 shown in FIG. 9, the drive mechanism group 68 and the motors 40 are related to predetermined heald frames except the number of motors. Such a correspondence relation between the motors and the heald frames is shown in FIG. 11, with the order of the corresponding heald frames from the forward side indicated by the Arabic numerals 1 through 10 under the motors 40. Also, among the Arabic numerals in two rows in the rightward and leftward direction, the numerals in the upper row correspond to the lower motor row, and the numerals in the lower row correspond to the upper motor row.

In case two drive mechanism groups 68, 70 are used, both drive mechanism groups 68, 70 are constituted as mentioned above. The correspondence relations between the motors and the heald frames of the drive mechanism groups 68 and 70 in such a case are respectively shown in FIG. 11 with the Arabic numerals 1 through 10 indicating the order from the forward side as well as numerals (11) through (20). Also, the embodiment shown in FIG. 11 has the similar constitution to those shown in FIGS. 2 and 3 except that the corresponding relation between the number of the drive motors 40 and the heald frames is different.

Figure 12:
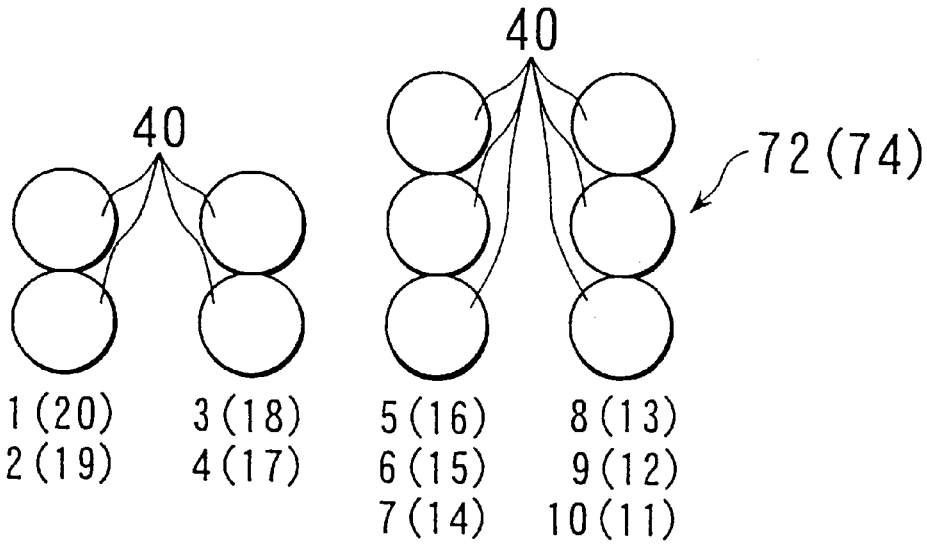
FIG. 12 is a view showing a fifth example of an arrangement of the drive mechanism group.

FIG. 12 shows embodiments of a drive mechanism group 72 (or two drive mechanism groups 72, 74 each having ten heald frames and ten drive motors 40 for a support mechanism) having ten drive motors 40 arranged in the upward, downward, rightward and leftward directions in three rows in the longitudinal direction of the connecting member such that four motors are arranged in each of upper and lower two rows with two motors on the top row.

The drive mechanism groups 72, 74 and the motors 40 are related to predetermined heald frames like the drive mechanism groups 62, 64 and the motors 40 as shown in FIG. 11, except that the motor rows are different. The correspondence relation of the motors and the heald frames such as above are shown in FIG. 12 with the Arabic numerals 1 through 10 and (11) through (20) below the motors 40, indicating the order of the corresponding head frames from the forward side. Among the Arabic numerals arranged in three rows in the rightward, leftward, upward and downward directions, the numerals on the top row correspond to the lowest row of the motors, the numerals in the second row correspond to the second motor row, and the numerals in the third row correspond to the top motor row.

Figure 13:
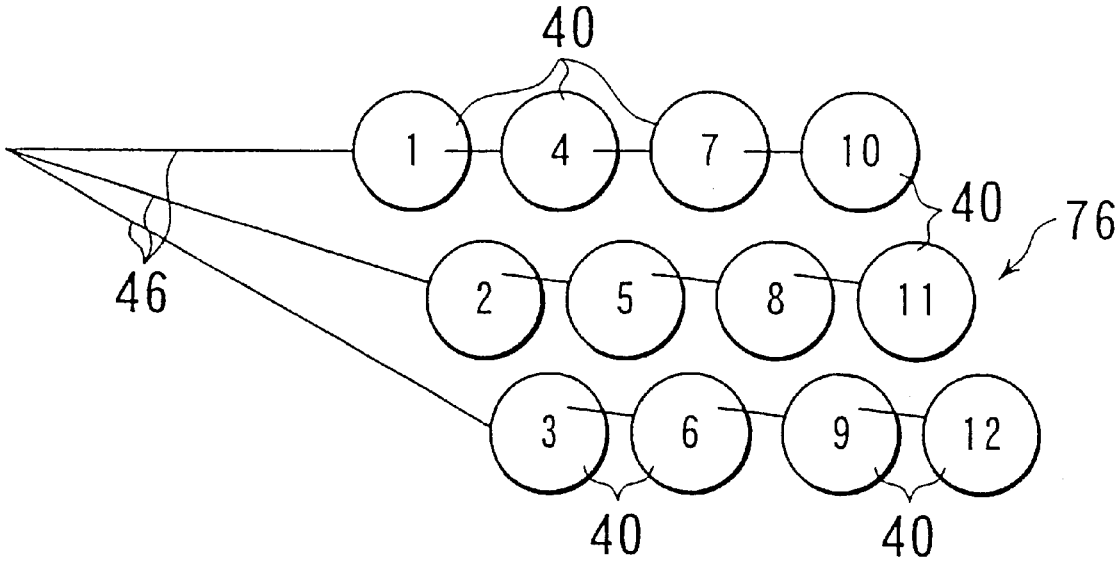
FIG. 13 is a view showing a sixth example of an arrangement of the drive mechanism group.

FIG. 13 shows an embodiment of a drive mechanism group 76 including a motor group in which twelve drive motors 40 are arranged upward, downward, rightward and leftward directions to form three motor rows in the upward and downward direction, each row having four motors in the longitudinal direction of the connecting member 46. The upward and downward motors 40 are displaced in the rightward and leftward direction with respect to their positions. The four motors 40 in each row respectively oppose to one connecting member connected with the farthest motor from the end portion of the connecting member on the side opposite to the motor.

The drive mechanism group 76 and the motors 40 are related to predetermined heald frames, like the drive mechanism group 62 and the motors 40 in FIG. 9 except that the array of the motors are different. The correspondence relation of the motors and the heald frames such as above is shown in FIG. 13 with the Arabic numerals 1 through 12 inside the motors 40 indicating the order of the corresponding heald frames from the forward side.

Figure 14:
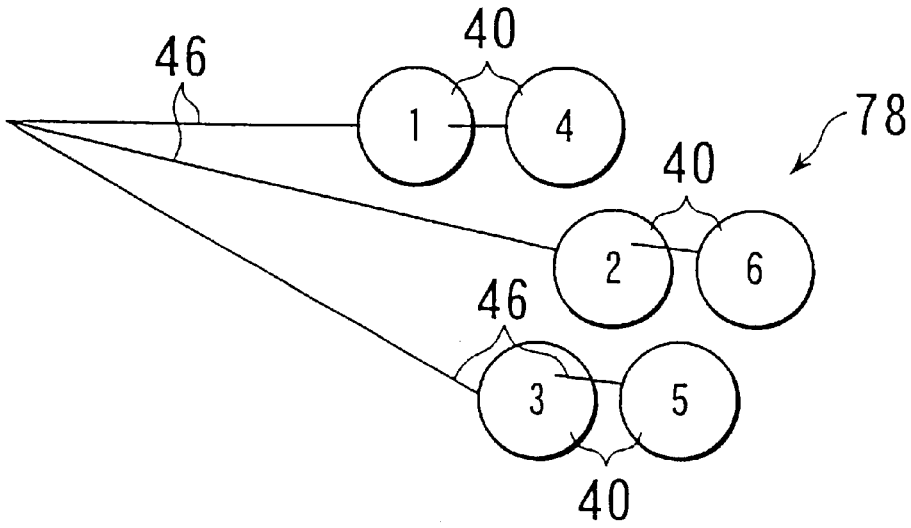
FIG. 14 is a view showing a seventh example of an arrangement of the drive mechanism group.

FIG. 14 shows an embodiment of a drive mechanism group 78 including a motor group in which six drive motors 40 are arranged on the upward, downward, rightward and leftward directions to form three motor rows in the upward and downward direction, each row having two motors in the longitudinal direction of the connecting member 46. The positions of the upper and lower motors 40 are displaced rightward and leftward.

A drive mechanism group 78 and the motors 40 are related to predetermined heald frames like the drive mechanism group 62 and the motors 40 shown in FIG. 9 except that the number and the array of the motors are different. The corresponding relation between the motors and the heald frames such as above is shown in FIG. 14 with the Arabic numerals 1 through 6 indicating the order of the corresponding heald frames from the forward inside the motors 40.

Figure 15:
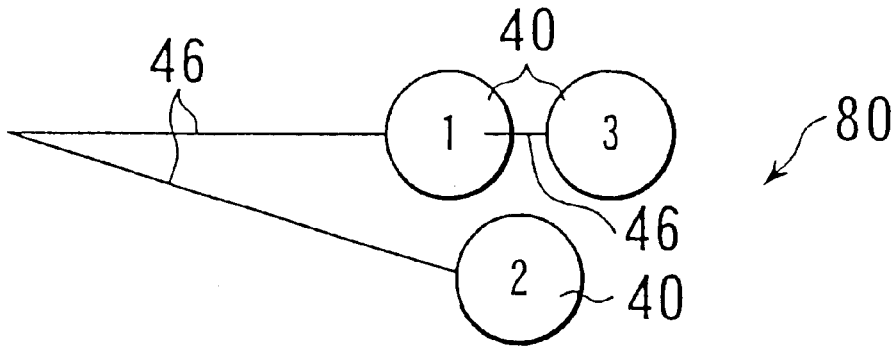
FIG. 15 is a view showing an eighth example of an arrangement of the drive mechanism group.

FIG. 15 shows an embodiment of a drive mechanism group 80 including a motor group, wherein three drive motors 40 are arranged in the upward, downward, rightward and leftward directions, two motors forming the upper row in the longitudinal direction of the connecting member 46 and the remaining motor forming one row under the motor row. The positions of the upper and lower motors 40 are displaced in the rightward and leftward direction.

The drive mechanism group 80 and the motors 40 are related to predetermined heald frames, like the drive mechanism group 62 and the motors 40 shown in FIG. 9, except that the number and the array of the motors are different. The correspondence relation of the motors and the heald frames such as above is shown in FIG. 15 with the Arabic numerals 1 through 3 indicating the order of the corresponding heald frames from the front side written within the motors 40. The positions of the upper and lower motors 40 are displaced rightward and leftward.

Figure 16:
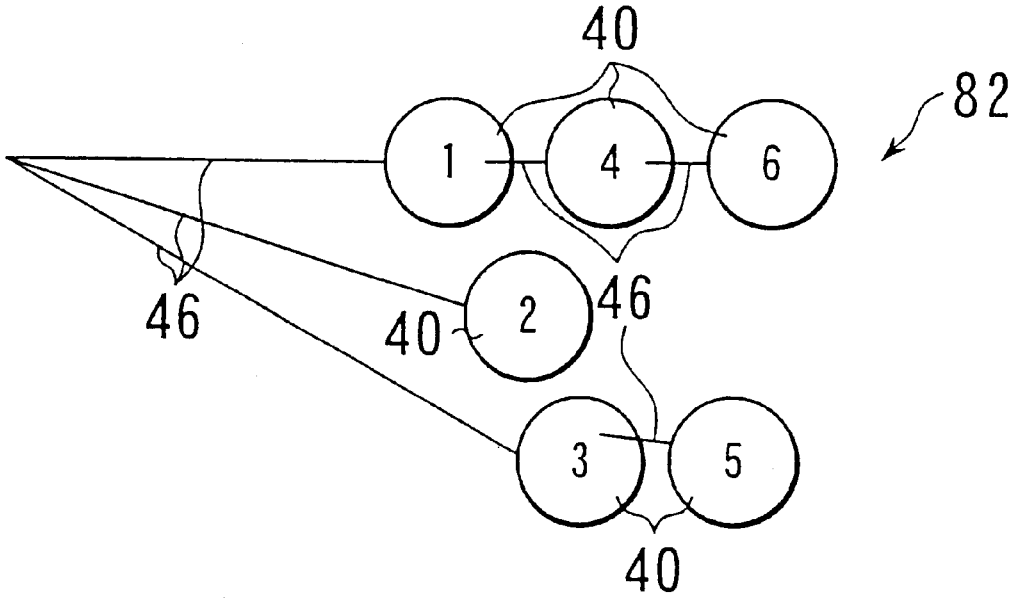
FIG. 16 is a view showing a ninth example of an arrangement of the drive mechanism group.

FIG. 16 shows an embodiment of a drive mechanism group 82 in which six drive motors 40 are arranged in the upward, downward, rightward and leftward directions such that three motors are arranged in one row in the longitudinal direction of the connecting member 46, two motors form one motor row in the longitudinal direction of the connecting member, and the remaining motor is arranged between the upper and the lower rows of the motors 40.

The drive mechanism group 82 and the motors 40 are related to predetermined heald frames, like the drive mechanism group 62 and the motors 40 shown in FIG. 9, except that the number and the array of the motors are different. The corresponding relation between the motors and the heald frames such as above is shown in FIG. 15 with the Arabic numerals 1 through 6 indicating the order of the corresponding heald frames from the forward side written within the motors 40.

Figure 17:
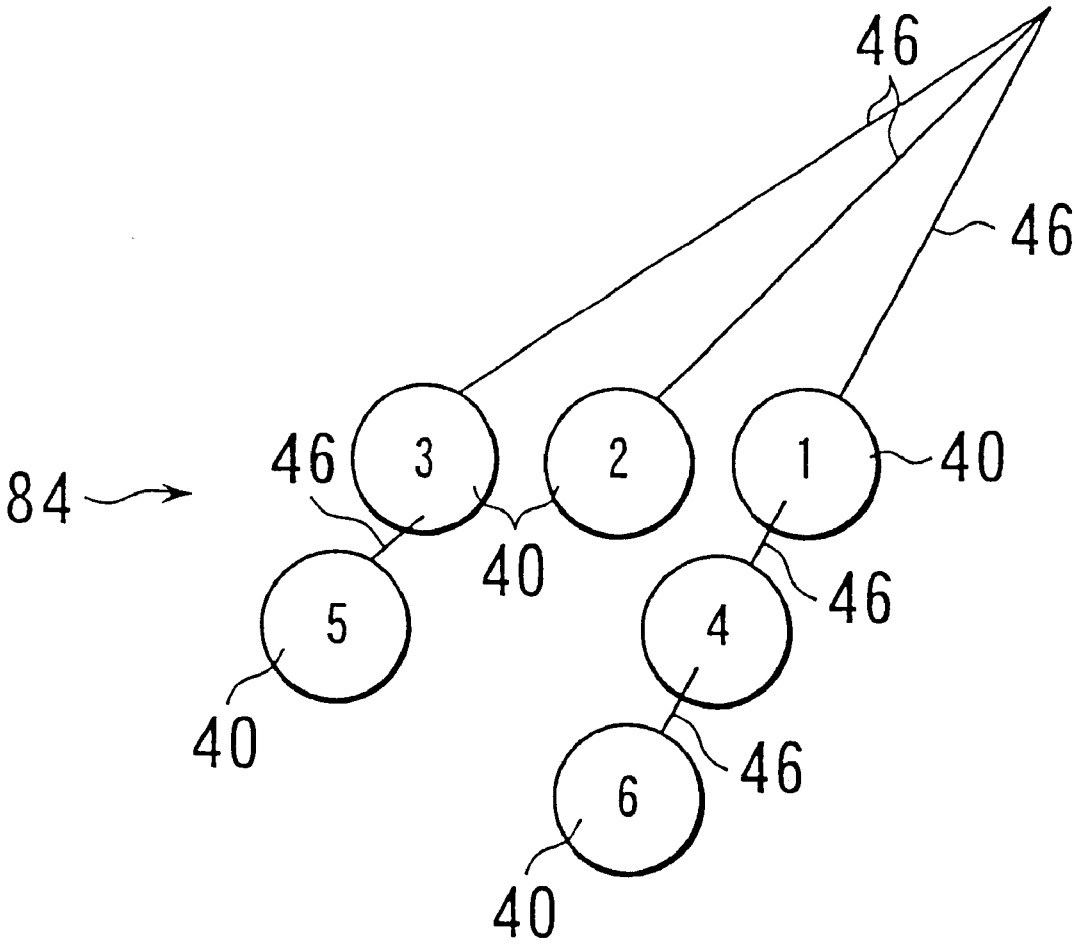
FIG. 17 is a view showing a tenth example of an arrangement of the drive mechanism group.

FIG. 17 shows an embodiment of the drive mechanism group 84 in which six drive motors 40 are arranged in the upward and downward, rightward and leftward directions such that three motors form one row in the longitudinal direction of the connecting member 46, two motors form one row in the longitudinal direction of the connecting member and the remaining motor is disposed between the two rows. The positions of the upper and lower motors 40 are displaced in the rightward and leftward direction.

The drive mechanism group 84 and the motors 40 are related to the predetermined heald frames, like the drive mechanism group 62 and the motors 40 shown in FIG. 9, except that the number and the array of the motors are different. The correspondence relation of the motors and the heald frames such as shown above is shown in FIG. 17 with the Arabic numerals indicating the order of the corresponding heald frames from the forward side written inside the motors 40.

In case a plurality of drive mechanism groups are used, the drive mechanism groups (i.e., motor groups) may be arranged at different positions at least in one direction selected from the forward and backward, upward and downward, and rightward and leftward directions. In case two drive mechanism groups are arranged in different positions in the rightward and leftward direction, one of the mechanism groups may be arranged outside or inside the left-side frame 12 with the other group disposed outside or inside the right-side frame 14.

All the above embodiments concern a plurality of heald frames corresponding to the support mechanisms with consecutive position numbers such as 1 through 6, 7 through 12 or 1 through 8, but they may concern a plurality of heald frames with non-consecutive numbers, for example, only odd-numbered positions or only even-numbered positions.

In more detail, the embodiments may be constituted by the first support mechanisms, first motor group and first motion converting mechanism group corresponding to plural heald frames whose position numbers are odd, the second support mechanism group, and the second motor group and the second motion converting mechanism group only corresponding to heald frames whose position numbers are even. In this case, suppose the total number of the heald frames is twelve, in the former the position Nos. of 1, 3, 5, 7, 9 and 11 are "heald frames corresponding to the support mechanisms" in the present invention, while in the latter the position Nos. of 2, 4, 6, 8, 10 and 12 are "heald frames corresponding to the second support mechanisms" in the present invention. Further, taking the former for instance, it can be said that the heald frames with the position Nos. 1, 3 or 3, 5 are adjoining heald frames, and that the heald frames with the position Nos. 1, 5 or 3, 7 are heald frames not adjacent to each other.

The present invention is not limited to the above embodiments. The present invention can be varied and modified without departing from its purpose.

What is claimed is:

1. A shedding device in a weaving machine, comprising: a support mechanism group including a plurality of support mechanisms individually supporting a plurality of heald frames so as to move said plurality of heald frames upward and downward, a motor group including a plurality of motors corresponding to said plurality of heald frames with their output shafts directed in the forward and backward direction of the weaving machine, and a motion converting mechanism group including a plurality of converting mechanisms each having a long connecting member for connecting the plurality of motors with the corresponding plurality of support mechanisms, wherein said plurality of motors in said motor group are disposed in the upward and downward, rightward and leftward directions, wherein two or more motors in said motor group form one or more motor rows arranged in the longitudinal direction of said connecting member, and wherein adjacent motors within said motor rows correspond to non-adjacent heald frames.

2. A shedding device as defined in claim 1, further comprising: a second support mechanism group including a plurality of second support mechanisms for individually supporting additional heald frames so as to move upward and downward; a second motor group including a plurality of second motors corresponding to said additional heald frames and with their output shafts directed forward and backward of the weaving machine; and a second motion converting mechanism group including a plurality of second converting mechanisms each with a long second connecting member for connecting said plurality of second motors with the corresponding plurality of second support mechanisms, wherein the second motors of said second motor group are arranged in the upward, downward, rightward and leftward directions, wherein two or more motors in said second motor group form one or more second motor rows arranged in the longitudinal direction of said second connecting member, and wherein adjacent motors within said second motor row are related to non-adjacent heald frames among the additional heald frames supported by said second support mechanisms.

3. A shedding device as defined in claim 2, wherein said second motor group and the motor group described in claim 1 are arranged in different positions in at least one direction selected from the forward and backward direction, the upward and downward direction and the rightward and leftward direction.

4. A shedding device as defined in claim 1, wherein the motors of the same motor row are related to the heald frames corresponding to the motors of said motor row such that the motors nearer to the end portion of the connecting member on the side opposite to the motors are related to the heald frames on one of the forward side and the backward side nearer to the side where the motor group is arranged, among the heald frames corresponding to said support mechanisms.

5. A shedding device as defined in claim 4, wherein heald frames adjacent to the heald frames related to the motors in the same row are related to other motors in said motor group not belonging to the same row.

6. A shedding device as defined in claim 1, wherein the motors of said motor group are arranged in plural rows respectively in the widthwise direction and upward and downward direction of the weaving machine;

wherein the heald frames supported by the support mechanisms of said support mechanism group are divided into a plurality of groups adjacent to each other, each of which includes a number of heald frames corresponding to the number of rows of motors arranged in the upward and downward direction, wherein the motors of the first upper and lower rows nearest to the end portion of said connecting member opposite said motors are made to correspond to the heald frames of a first heald frame group nearest to the forward side or the backward side of the weaving machine, and wherein the motors of the other upper and lower rows and the heald frames of the other groups are made to correspond such that the order of proximity of the upper and lower rows to which the motors belong relative to said first upper and lower rows coincide with the order of proximity of the group to which said heald frames belong relative to said first heald frame group.

* * * * *